US006834453B1

(12) United States Patent
Nemeth

(10) Patent No.: US 6,834,453 B1
(45) Date of Patent: Dec. 28, 2004

(54) HEAD MOUNTED LETTER "M" DISPLAY

(76) Inventor: Richard Eric Nemeth, 2367 NE. John Carlson Rd., Bremerton, WA (US) 98311

( * ) Notice: Subject to any disclaimer, the term of this patent is extended or adjusted under 35 U.S.C. 154(b) by 374 days.

(21) Appl. No.: 09/669,150

(22) Filed: Sep. 25, 2000

(51) Int. Cl.[7] ..... G09F 21/02

(52) U.S. Cl. ..... 40/586; D2/869; D2/895; 2/171; 2/200.1

(58) Field of Search ..... 40/586, 618, 620, 40/539, 596; 2/171, 200.2, 269.13, DIG. 10, 200.1, 175.1; D2/866, 865, 869, 895; 434/159, 160

(56) References Cited

U.S. PATENT DOCUMENTS 1,245,475 A * 11/1917 Lindheim ..... 434/159
3,440,750 A * 4/1969 Toth et al. ..... 434/159
4,335,471 A * 6/1982 Quigley et al. ..... 2/12
6,012,174 A * 1/2000 Rech et al. ..... 2/200.1
D449,424 S * 10/2001 Dorner et al. ..... D2/869

OTHER PUBLICATIONS

Foam Bath Stickers, 1996, Lilly Kids Catalog, p. 12.*

* cited by examiner

*Primary Examiner*—Cassandra Davis
(74) *Attorney, Agent, or Firm*—Delbert J Barnard

(57) ABSTRACT

A foam body is made in the form if the letter "M". Side portions of the foam body include confronting, temple engaging, inside surfaces, spaced apart a distance less than the temple—temple width of a person's head. The foam body is constructed from a springable form that stores spring energy when bent and allows the side portions to be sprung apart, and when released to move back towards each other. The side portions of the form body are sprung apart and a person places his/her head between the side portions. Then the side portions are released so that they will spring back towards their static positions and clamp onto the person's head, so as to secure the letter "M" display onto the person's head.

10 Claims, 5 Drawing Sheets

HEAD MOUNTED LETTER "M" DISPLAY

TECHNICAL FIELD

This invention relates to a novelty item for showing fan support for a sports team. More particularly, it relates to a foam plastic letter "M" display that is adapted to be self-securing onto the head of a person.

BACKGROUND OF THE INVENTION

Fan interest for sports teams goes beyond merely watching the teams perform. The fans come to games wearing clothing and other items, and/or carrying signs or other displays showing their support for their team. Fan worn displays include replicas of team hats, jerseys, etc. and other items that are created by or for the fans.

It is an object of the present invention to provide a display that is adapted to be mounted onto the head of a fan and which is provided with the shape of a letter "M" that has some association with a particular team. For example, the Seattle Mariners baseball team is commonly referred to as the "M's." It is an object of the invention to provide a display in the shape of a "M" that is adapted to be self-secured to the head of a fan, so that, for example, the fan can wear it to a game or elsewhere.

BRIEF SUMMARY OF THE INVENTION

The letter "M" display of the present invention is basically characterized by a foam body having the shape of a letter "M" and including a pair of laterally spaced apart side portions and an interconnecting portion. The interconnecting portion forms a substantially "V" shaped central upper portion of the letter "M". The side portions depend from the interconnecting portion and define a space between them, below the interconnecting portion. The side portions of the foam body also form the side parts of the letter "M".

According to an aspect of the invention, the side portions of the foam body include confronting, temple engaging, inside surfaces, spaced apart a distance less than the temple-to-temple width of a person's head. The foam body is constructed from a springable foam that stores spring energy when bent and allows the side portions to be sprung apart, and when released moved back towards each other. The side portions of the foam body can be sprung apart so as to enable a person to place his/her head between the side portions. Then, the side portions can be released so that they will spring back towards their static positions and clamp onto the person's head. In this manner, the letter "M" display is secured to the person's head.

Preferably also, the foam body is compressable and when compressed will store spring energy. When the letter "M" display is clamped onto a person's head, there will be some compressing of the side portions of the foam body. This compression will store further spring energy that will act together with the bending spring energy to clamp the display onto the person's head. In preferred form, the foam body is constructed from a flexible polyurethane foam. The side portions of the foam body are squared members and the inside surfaces of the side portions are substantially planar and parallel to each other.

Accordingly to a further aspect of the invention, the foam body is provided with at least one color that is a color associated with a particular sports team. For example, the color blue is a color that is associated with the Seattle Mariners. In preferred form, the foam body includes a border outlining the letter "M" that is a first color that is associated with a particular sports team. Within the border, the foam body is covered with a second color that is associated with the same team. For example, the first color may be the color gold and a second may be the color blue. Both of these colors are associated with the Seattle Mariners.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

Like reference numerals are used to designate like parts throughout the several views of the drawing, and.

DETAILED DESCRIPTION OF THE INVENTION

Figure 1:
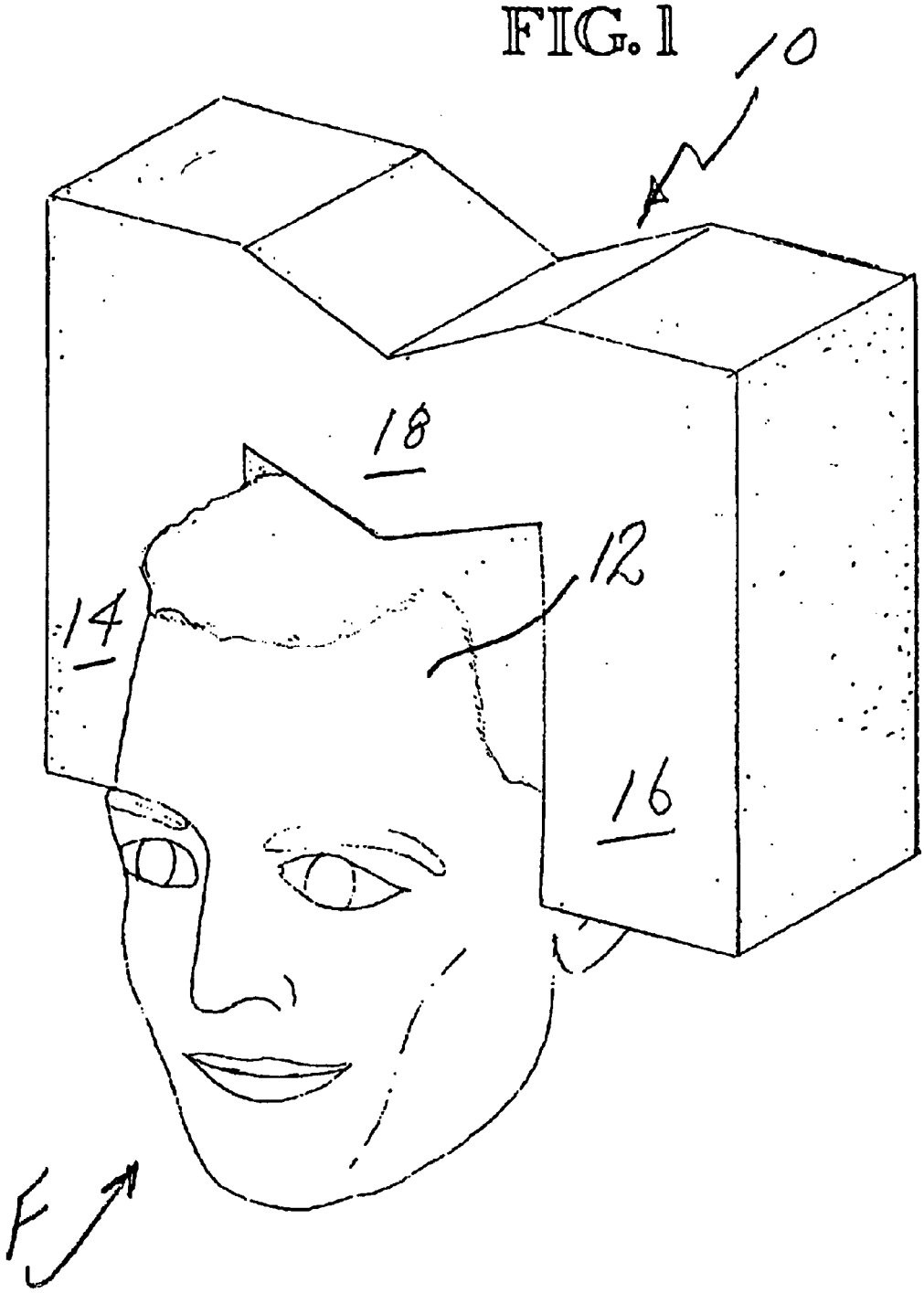
FIG. 1 is a pictorial view taken from above and looking towards the front, top and one side of a letter "M" display mounted on a head of a wearer.
Figure 2:
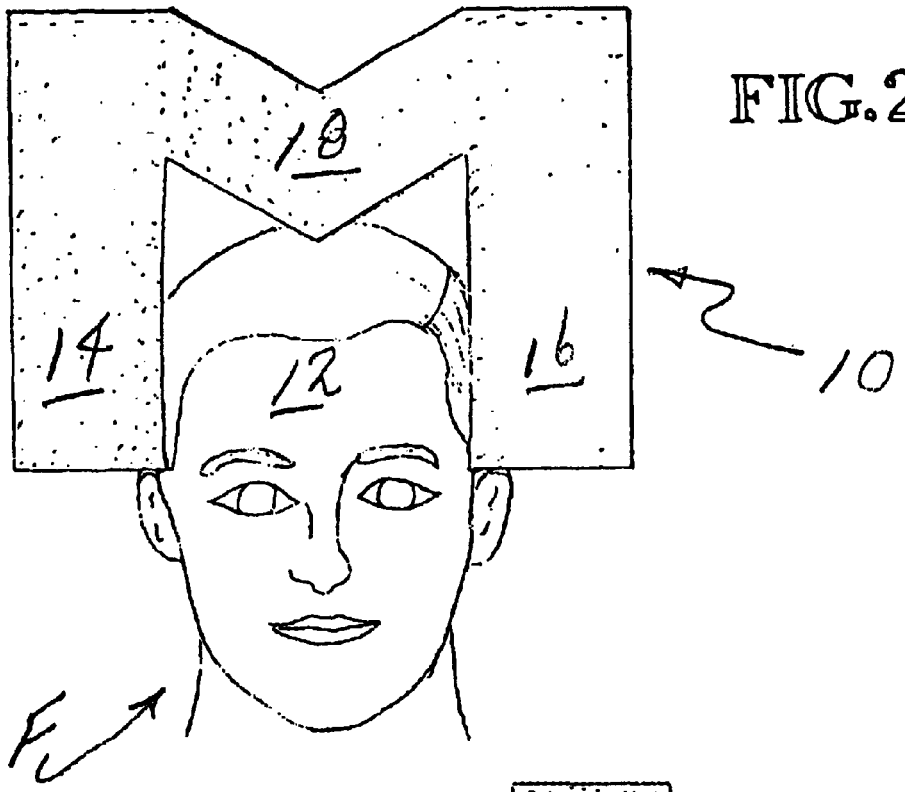
FIG. 2 is a front elevational view of the letter "M" display shown on the head of a wearer.
Figure 3:
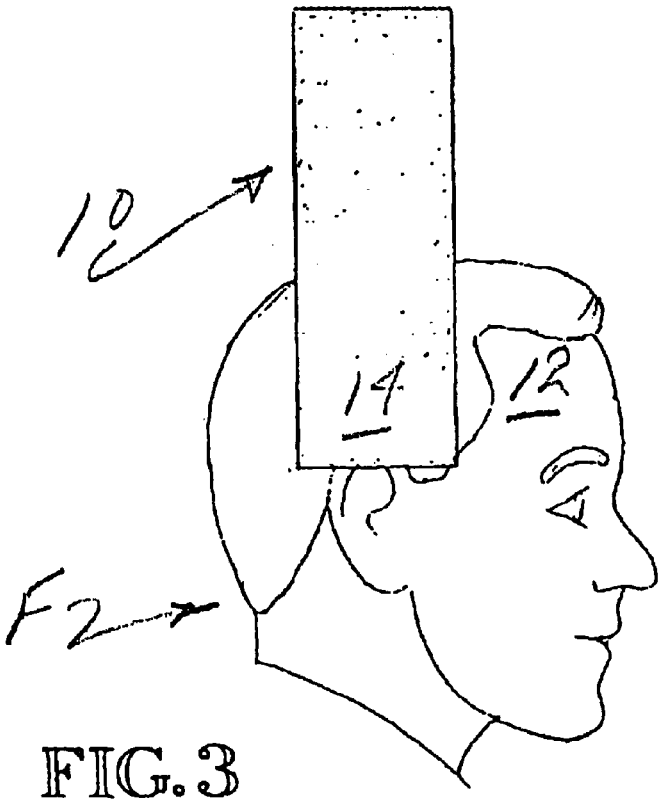
FIG. 3 is a side elevational view of the letter "M" display shown on the head of a wearer.
Figure 4:
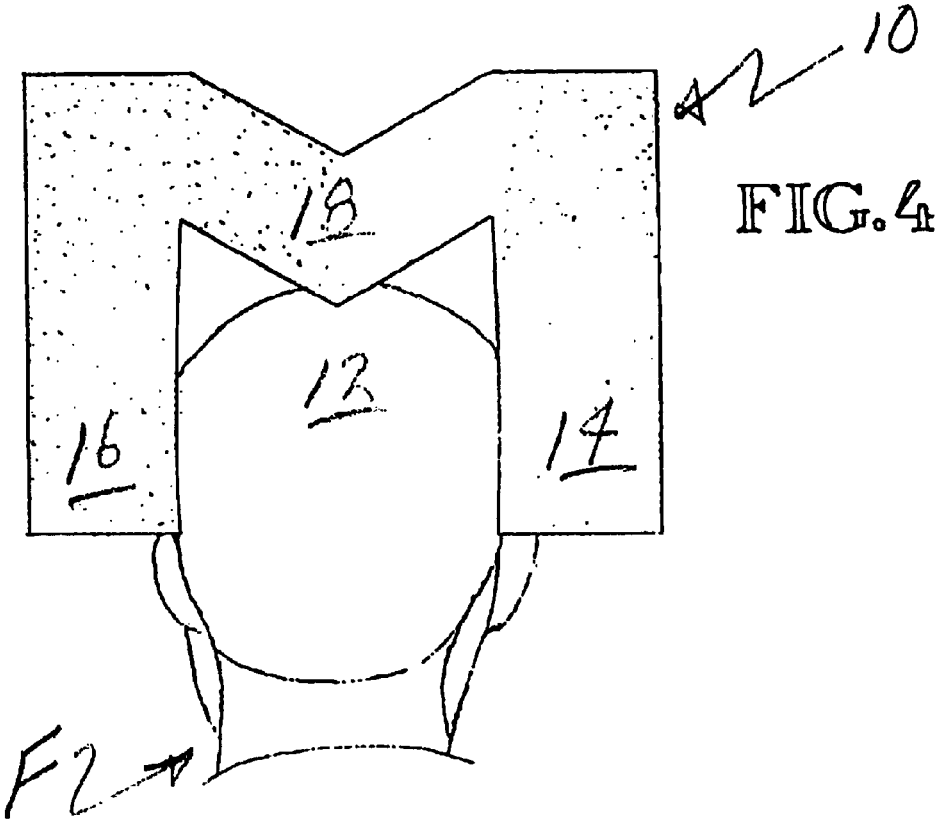
FIG. 4 is a top plan view of the letter "M" display shown on the head of a wearer.
Figure 5:
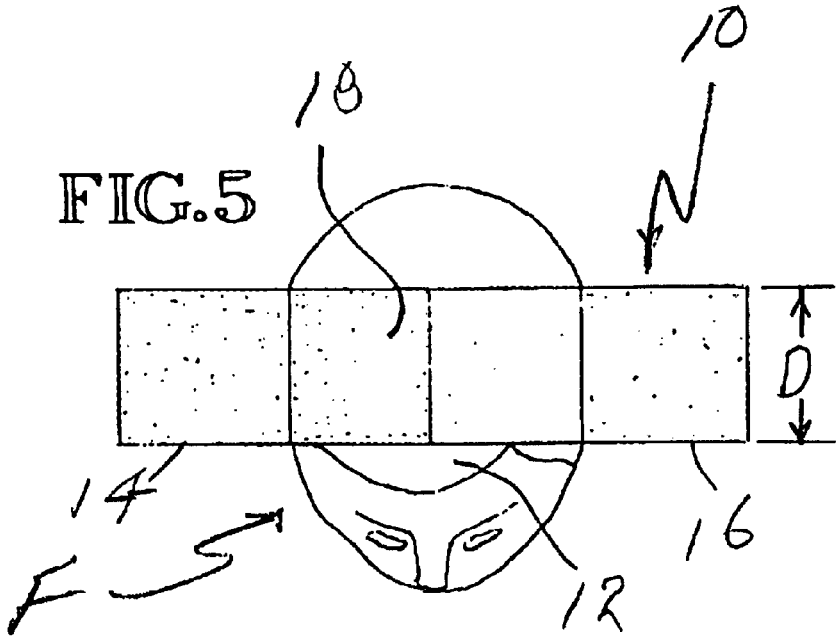
FIG. 5 is a rear elevational view of the letter "M" display shown on the head of a wearer.
Figure 6:
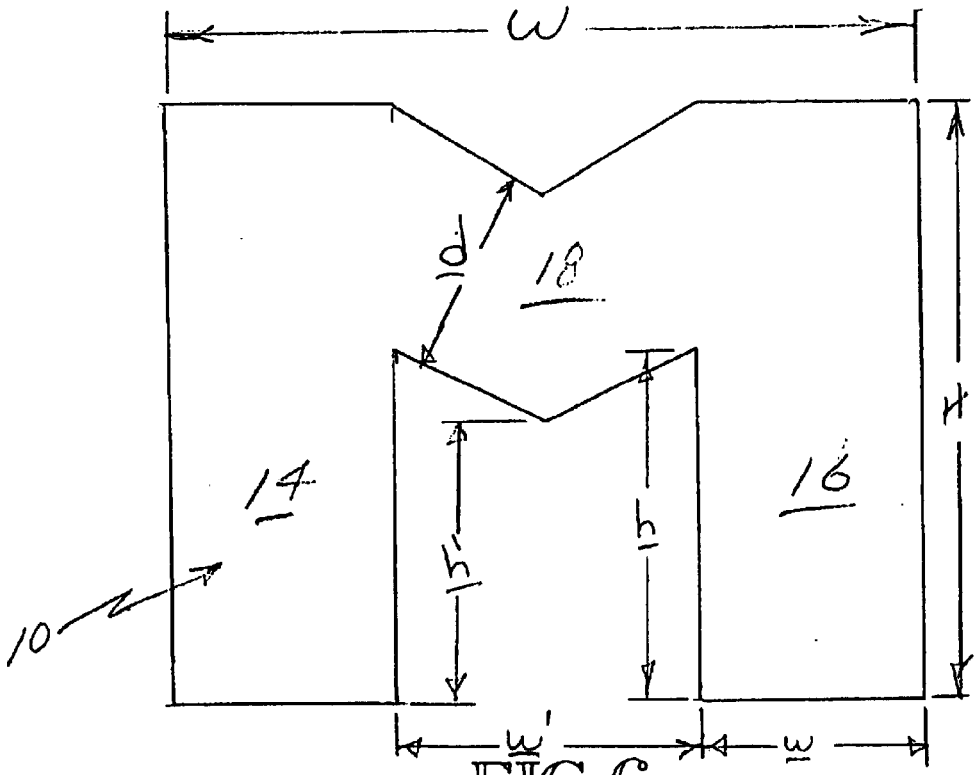
FIG. 6 is an elevational view, taken from either the front or the rear, of the letter "M" display.
Figure 7:
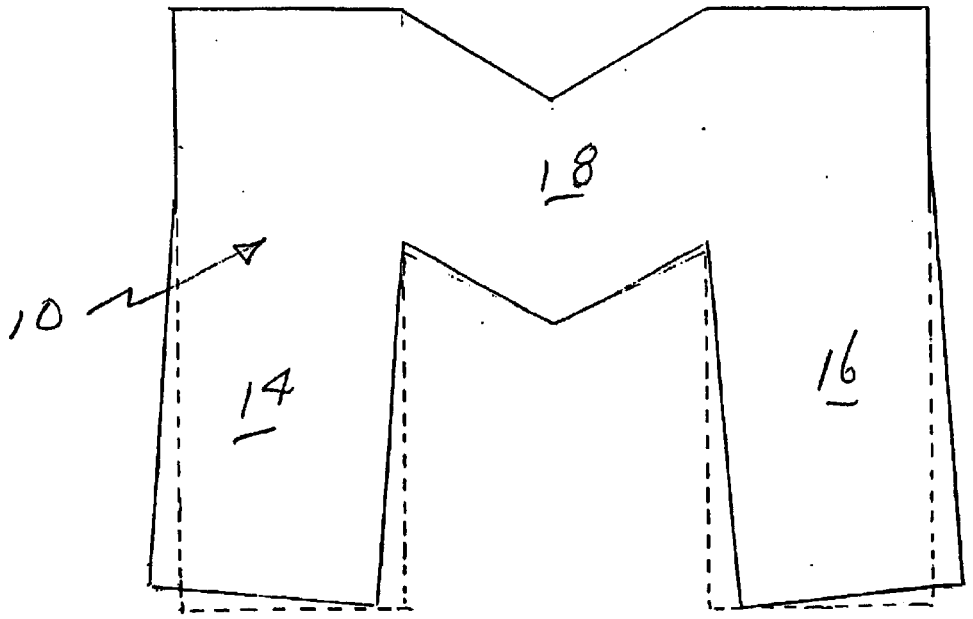
FIG. 7 is a view like FIG. 6 but showing the side portions of the "M" being spread apart so as to widen the space between them.

Referring to FIGS. 1–5, the letter "M" display 10 is shown mounted onto the head 12 of the fan "F". As shown by FIGS. 1, 2 and 5–9, the display 10 is composed of a pair of side portions 14, 16 and an interconnecting upper central portion 18. Together, portions 14, 16, 18 form the shape of a "M". The upper central portion 18 by itself has a substantially "V" shape.

The display 10 is cut from a single piece of foam plastic. A suitable plastic is flexible polyurethane foam CAS#9009-54-5, manufactured by Foamex International Inc., having a business address at 1000 Columbia Avenue, Linwood, Pa. 19061. This foam is a fully cross-linked reaction product of polyhydroxy polyol, tolucne di-isocyanate, catalyst, surfactants, pigments and water. Polyurethane foam product is a polymeric material consisting of repeating units of carbon, hydrogen, oxygen and nitrogen. This is a preferred foam material but other foam materials can be used in its place, e.g. foam latex, polyethylene, vinyl polymers, polystyrene, epoxy and polyvinyl chlorides.

By way of example, the side portions 14, 16 may have an outside height H of about ten and one half inches (10½ in.), and inside height h of about six and one half inches (6½ in.), a width w of about four inches (4 in.) and a depth D of about three-four inches (3–4 in.). The total width W of the display 10 is about thirteen and one-half inches (13.5 in.). The head space width w' is about five and one half inches (5½ in.) The head space height h' is about five inches (5 in.). All of these dimensions can vary somewhat but the most critical dimensions are as the head height h' and the head width w' dimensions of these two dimensions, the more critical is the head width dimension we. However, to some extent this dimension fixes the other dimensions of the display 10 for the reason that it is desirable to have the letter "M" as realistic looking as possible. The letter "M" itself establishes proportions that must exist in order for the "M" to have a realistic appearance. This being said, it would still be possible to provide the letter "M" with a wider total width W, a taller total height H and then make the width dimensions w of the side portions 14, 16 wider and the dimension d larger, while maintaining the head space w'.

The foam body is resilient in two ways. The first is in "flexure." The second is in "compression." Referring to FIG. 6, the side portions 14, 16 are in effect cantilever beams. They depend from the upper central portion 18. Their connection to the upper central portion 18 in effect fixes their upper ends. In their extents below the interconnecting portion 18, the side portions 14, 16 can "flex." They can be grasped near their lower ends and pulled apart slightly, into the positions shown by solid lines in FIG. 7. This bending or flexing of the side parts 14, 16 stores spring energy in them so that they will behave as leaf springs. The fan, or a helper, pulls the side portions 14, 16 apart and sets the display 10 down onto the head 12 of the fan. Then, the side portions are released. This causes the stored spring energy to want to move the side portions 14, 16 back to their static positions shown in FIG. 6. However, this is prevented because the fan's head 12 is in the space between the side portions 14, 16 and below the upper portion 18. As a result, the spring energy moves the side portions 14, 16 into a clamping engagement with the upper side portions of the fan's head 12.

The head space width w' may also be described as being a dimension that is less than the temple-to-temple width of a person's head. As a result, the side portions 14, 16 must be spread apart in order for the head 12 to be received between them.

Figure 8:
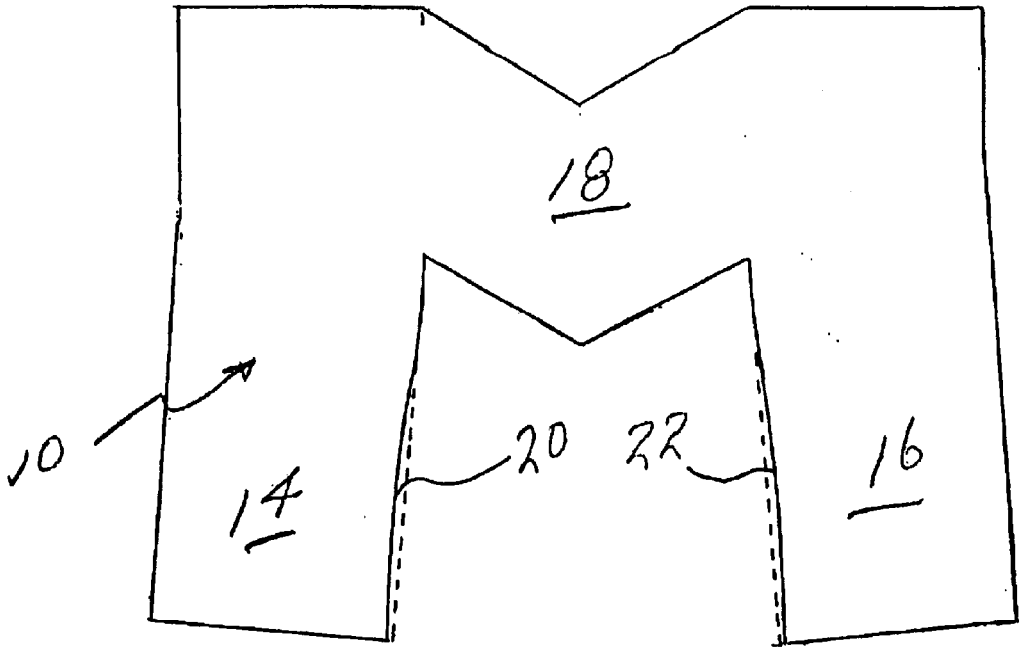
FIG. 8 is a view like FIG. 6 showing the side portions of the "M" both spread apart and compressed slightly on the their inner sides, exemplifying the configuration they would take when a wearer's head is between them.

There is a second way in which spring energy is stored in the body of the display 10. That is by some compression of the foam material itself. This is shown in FIG. 8 where the inside surfaces 20, 22 of the side portions 14, 16 are shown to have a an slightly concave shape. When the stored spring energy in the side portions 14, 16 moves the side portions 14, 16 against the head 12, the side portions of the head 12 will slightly compress the foam material in the regions 20, 22. This compression stores spring energy in the form that wants to return the foam back to its original shape. Both types of spring energy help to hold the letter "M" on the head 12 of the fan F. In preferred form, a body of foam plastic of an appropriate thickness, e.g. three-four inches (3–4 in.) is produced and cut to form the letter "M". Cutting equipment is available to cut the foam very precisely and provide it with true surfaces where cut. Preferably, the letter "M" is cut so that all of the surfaces that extend from one face of the letter "M" to the other are perpendicular to both faces. Also, the horizontal surfaces should be perpendicular to the vertical surfaces. Thus, the surfaces at the tops and bottoms of the side portions 14, 16 are preferably made to be perpendicular to the inside and outside side surfaces of the side portions 14, 16. This form of cutting results in the side portions of the foam body being "squared members". It results in the inside surfaces of the side portions 14, 16 being substantially planar and parallel to each other.

Figure 9:
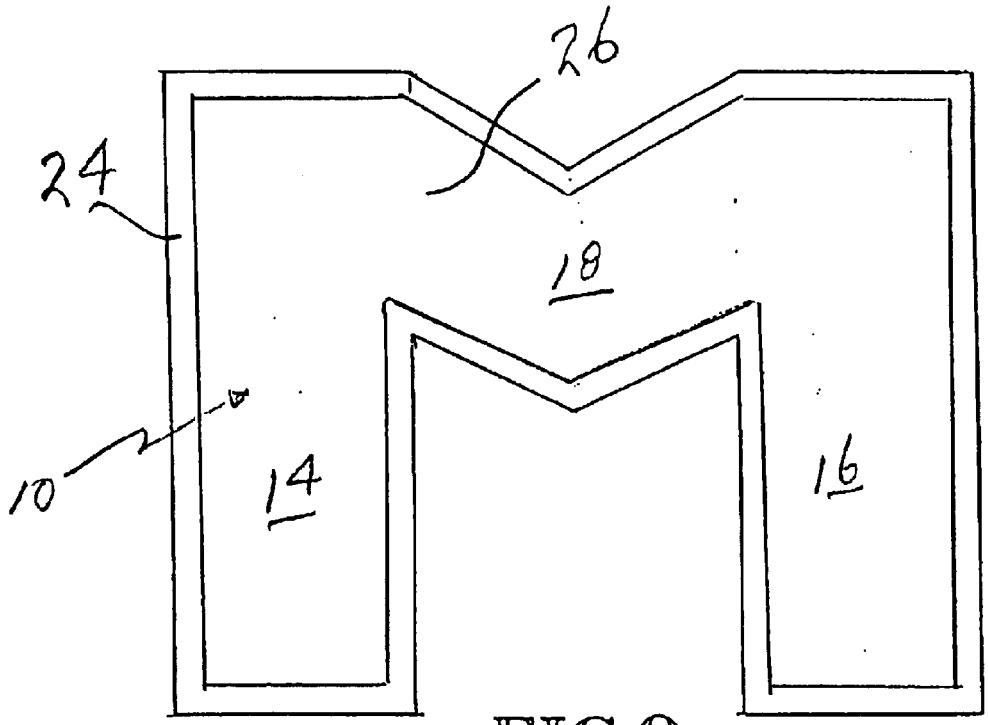
FIG. 9 is a view like FIG. 6, but showing a display having a border of a first color and an inside-the-border portion that is a second color.

The letter "M" display 10 may display a single color that is one of the colors associated with a given team, e.g. the color "blue" for the Mariners. Referring to FIG. 9, the letter "M" may be provided with a border 24 that is of a first color associated with the team and a second color in the region 26 inside the border 24 that is of a second color associated with the team. For example, border 24 may be "gold" and the insider-the-border portion 26 may be colored blue.

A colored composition may be used to form the foam. Or, the foam can be formed and then painted or otherwise coated to provide the color. Also, it may be desirable to coat the outer % surface of the foam with a plastic film coating or "skin." A metalized coating or film may be applied to the letter "M". Also, it may be desirable to provide it with a glow-in-the-dark coating or film.

The illustrated embodiments are only examples of the present invention and, therefore, are non-limitive. It is to be understood that many changes in the particular structure, materials and features of the invention may be made without departing from the spirit and scope of the invention. For example, the letter "M" may be provided with a head strap against which the forehead of the wearer presses. The side portions of the head strap may go rearwardly through the head space and be glued or otherwise attached to the inside surfaces of the side portions 14, 16. Behind the display, the straps may have end portions that are connectable together by a Velcro type fastener or by a button and opening fastener of the type used to make baseball caps adjustable. Also, it may be desired to provide the display 10 with a tether. An opening may be formed through a portion of the display 10 and one end portion of the tether pushed through the opening and then brought around and secured to another portion of the tether. The opposite end of the tether may be provided with a safety pin or the like that can be secured to an article of clothing worn by the fan F.

Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A letter "M" display, mountable on a person's head, comprising:

a foam body in the shape of a letter "M" and including a pair of laterally spaced apart side portions and an interconnecting portion;

said interconnecting portion forming a substantially "V" shaped central upper portion of the letter "M";

said side portions depending from said interconnecting portion and defining a space between them, below the interconnecting portion, and forming the side portions of god the letter "M";

said side portions of the foam body including confronting, temple engaging, inside surfaces, spaced apart a distances less than a temple-temple width of a person's head;

said foam body being constructed from a springable foam that stores spring energy when bent and allows the side portions to be sprung apart, and when released move back towards each other, whereby the side portions of the foam body are adapted to be sprung apart so as to enable a person to place his/her head between the side portions, and the side portions can be released so that they will spring back towards their static positions and clamp onto the person's head, so as to secure the letter "M" display onto the person's head.

2. The letter "M" display of claim 1, wherein the foam body is constructed from a flexible polyurethane foam.

3. The letter "M" display of claim 1, wherein the foam body is compressable and when compressed will store spring energy, and wherein there is some compression of the side portions of the foam body when the foam body is clamped onto a person's head.

4. The letter "M" display of claim 3, wherein the foam body is a flexible polyurethane foam.

5. The letter "M" display of claim 1, wherein the side portions of the foam body are squared members and the inside surfaces of the side portions are substantially planar and are parallel to each other.

6. The letter "M" display of claim 1, wherein the foam body is provided with at least one color that is a color associated with a particular sports team.

7. The letter "M" display of claim 6, wherein the side portions of the foam body are squared members and the inside surfaces of the side portions are substantially planar and are parallel to each other.

8. The letter "M" display of claim 1, wherein the foam body includes a border outlining the letter "M" that is of a first color that is associated with a particular sports team, and within the border the foam body is colored with a second color that is associated with the same team.

9. The letter "M" display of claim 8, wherein the side portions of the foam body are squared members and the inside surfaces of the side portions are substantially planar and are parallel to each other.

10. The letter "M" display of claim 9, wherein the foam body is a flexible polyurethane foam.

* * * * *